US011713163B2

(12) United States Patent
Cotte et al.

(10) Patent No.: US 11,713,163 B2
(45) Date of Patent: Aug. 1, 2023

(54) PACKAGING HEM COMPRISING MEANS FOR RETAINING AN OBJECT

(71) Applicant: PA. Cotte SA, Pully (CH)

(72) Inventors: Pierre-Alain Cotte, Amberg (DE); Simon Guilloux, Nantes (FR)

(73) Assignee: PA. Cotte SA, Pully (CH)

( * ) Notice: Subject to any disclaimer, the term of this patent is extended or adjusted under 35 U.S.C. 154(b) by 0 days.

(21) Appl. No.: 17/625,031

(22) PCT Filed: Jul. 2, 2020

(86) PCT No.: PCT/EP2020/068750
§ 371 (c)(1),
(2) Date: Jan. 5, 2022

(87) PCT Pub. No.: WO2021/004907
PCT Pub. Date: Jan. 14, 2021

(65) Prior Publication Data

US 2022/0204215 A1 Jun. 30, 2022

(30) Foreign Application Priority Data

Jul. 8, 2019 (FR) ..... 1907580

(51) Int. Cl.
*B65D 25/10* (2006.01)
*B65D 6/18* (2006.01)
(Continued)

(52) U.S. Cl.
CPC ..... *B65D 25/101* (2013.01); *B65D 11/1833* (2013.01); *B65D 43/163* (2013.01); *B65D 81/05* (2013.01)

(58) Field of Classification Search
CPC .. B65D 25/101; B65D 81/05; B65D 11/1833; B65D 43/163; B25H 3/021; B25H 3/023; B25H 3/026
See application file for complete search history.

(56) References Cited

U.S. PATENT DOCUMENTS

| | | | | |
|---|---|---|---|---|
| 9,089,965 | B1 * | 7/2015 | Cheng | B65D 43/16 |
| 2009/0084703 | A1 | 4/2009 | Eskenazi | |
| 2012/0217276 | A1 * | 8/2012 | Kennedy | B25H 3/022 224/400 |

FOREIGN PATENT DOCUMENTS

| | | |
|---|---|---|
| CN | 208412450 | 1/2019 |
| GB | 683272 | 11/1951 |
| JP | 2017095130 | 6/2017 |

OTHER PUBLICATIONS

International Search Report and Written Opinion issued by the European Patent Office, dated Aug. 13, 2020, for International Patent Application No. PCT/EP2020/068750; 12 pages.
(Continued)

*Primary Examiner* — Anthony D Stashick
*Assistant Examiner* — L Kmet
(74) *Attorney, Agent, or Firm* — Faegre Drinker Biddle & Reath LLP

(57) ABSTRACT

The invention relates to a package comprising a case having a bottom and a peripheral rim, the package also comprising a cover rotatably mounted on a side carrying the peripheral rim, and holding means for maintaining an object to be transported in the case, characterized in that the holding means comprise a frame rotatably mounted on the peripheral rim in the vicinity of the bottom of the case, the holding means also comprising elastically deformable means extending inside the frame, and a connecting rod for connection between the frame and the cover, the connecting rod being rotatably mounted on the cover and on the frame, the connecting rod, the cover, the side carrying the peripheral rim and the frame together forming a deformable parallelogram.

11 Claims, 9 Drawing Sheets

(51) Int. Cl.
*B65D 43/16* (2006.01)
*B65D 81/05* (2006.01)

(56) References Cited

OTHER PUBLICATIONS

English translation of the International Search Report, dated Aug. 13, 2020, for International Patent Application No. PCT/EP2020/068750; 2 pages.
English translation of the Written Opinion, dated Aug. 13, 2020, or International Patent Application No. PCT/EP2020/068750; 3 pages.

* cited by examiner

PACKAGING HEM COMPRISING MEANS FOR RETAINING AN OBJECT

CROSS-REFERENCE TO RELATED APPLICATIONS

The present application is a national stage entry of International (PCT) Patent Application Number PCT/EP2020/068750, filed Jul. 2, 2020, which claims priority to French Patent Application Number 1907580, filed Jul. 8, 2019, the subject matter of which are expressly incorporated herein by reference.

The field of the invention is that of logistics.

More specifically, the invention relates to a package, or a logistic packaging means, that is to say a container, for conveying objects between two destinations, by means of a package.

To transport an object in complete safety, and in a secure manner, packages such as cases or cartons are known.

In general, packages comprise a case having a bottom and a peripheral rim which together define an internal volume in which the object to be transported is housed.

The peripheral rim can be movable with respect to the bottom of the case. As such, it comprises several panels that can be folded on the bottom or in the extension of the bottom of the case.

The packages also comprise a cover which is movable with respect to the case. These covers can in particular adopt a closed position in which the cover closes the internal volume of the case.

In order to allow the protection of the objects transported, some packages comprise holding means to maintain the object to be transported in the case.

Holding means which are in the form of a foam panels integrated into the case and the cover are known. The foam panels can be attached to the case if required. In other words, the foam panels can be integrated into the case only if their presence is required.

More specifically, the foam panels are secured to the bottom of the case, optionally to its peripheral rim, and to the cover.

The object to be transported is then inserted into the internal volume so as to contact the foam and to be blocked at least by the foam of the bottom and the foam of the cover.

This type of holding means has the major disadvantage of its thickness, or, in other words, the space it occupies in the internal volume of the case.

Indeed, the foam takes up a major part of the internal volume of the case. However, the foam has elastic features so as to form deformable holding means to conform to the contour of the object to be transported.

However, depending on the size of the object, several packages should be provided.

For example, for a large object and for a small object, the same case cannot be used. In the case of the small object, if a case or package suitable for a large object is used, the foam is not deformed suitably on contact with the small object, and the latter may then displace in the internal volume of the case at the risk of being damaged.

On the contrary, if a large object is introduced into the internal volume of a case intended to contain a small object, the package may become unusable because of insufficient space in the internal volume, the cover therefore not being able to be closed properly so as to actually block the internal volume of the case. As a result, the object is not really protected and is visible to anyone carrying the package, which can lead to a risk of theft of the object.

Transporters or packaging professionals must consequently have packages of different sizes depending on the size of the objects to be transported.

Moreover, the presence of the foam makes the package bulky when not n use, even if the package is foldable to bring it into a stowing configuration or liar storage.

Indeed, folding the package allows to optimize its space requirement when not in use. However, the compression of the foam when folding the device can affect the effectiveness of the foam in protecting the object to be transported. When the foam is compressed, it loses elasticity, and may not expand properly upon decompression; this is particularly true as the duration of compression of the foam is significant.

To avoid this loss of elasticity, it is therefore necessary to avoid excessive compression of the foam, which only allows a partial reduction in the space requirement of the package when it is not in use.

Transporters or packaging professionals must, consequently, benefit from a large room allowing the storage of packages either in their use configuration, or partially folded, or separated, that is to say that the foam is separated from the case for the different package sizes. This then represents a significant storage cost which is generally charged to the final consumer.

According to another known technique, the holding means are in the shape of a plastic envelope inside which the object to be transported is slipped, the envelope is then deformed so that its walls contact the object to be transported and keep it in its position.

According to a first type, the envelopes can be secured to the bottom of the case and their deformation can be carried out for example by heating so as to retract the material, generally a plastic material, so that the latter stiffens upon contact with the object.

A disadvantage of this solution lies in the fact that the deformation of the envelope, when it is carried out by heating, cannot be carried out by everyone since this technique involves the use of specific heating equipment.

Indeed, heating means, such as heaters for example, must be used and may require special training so that only professionals can deform the envelope.

Moreover, when the envelope is secured to the bottom of the case, this may have a major disadvantage to the integrity of the case, especially if the latter is made of cardboard, too high heat being able to destroy the cardboard by burning it.

In addition, inserting the object to be transported into the envelope can be difficult, if not impossible.

This is particularly verified if the object to be transported is inserted into the envelope once the case is in shape, that is to say the internal volume is defined, the peripheral rim of the case forming a major obstacle when the object is inserted into the envelope.

To overcome this, it may be necessary to first insert the object into the envelope then to form the case and finally to deform the envelope.

This represents a significant handling time which can be detrimental for professionals and also be impossible to be performed for individuals, in particular to deform the envelope or shape the case.

According to a second type, the envelope can also be secured to a plate intended to be housed in the case. In this case, the object is introduced inside the envelope then, in order to secure and maintain the object, the envelope is deformed by folding the edges of the plate, so as to stretch the two walls of the envelope to trap the object. Once this is complete, the folded plate can be inserted into the case then the movable cover can be closed on the case.

These holding means also have some disadvantages.

Indeed, the insertion of the object into the envelope does not pose a problem, however the deformation of the plate, in particular the folding of its edges represents a complicated handling, even impossible to achieve when the object is large and the envelope to be deformed offers high resistance to deformation. The deformation of the envelope can then become time-consuming and put off professionals who will then do a partial deformation or else propose a larger package, resulting in a higher transport cost for the final consumer.

Furthermore, this requires the storage of both the case, the cover and the holding means, which represents a detrimental space requirement and therefore an additional cost which is often passed on to the final customer.

The purpose of the invention is in particular to overcome the disadvantages of the prior art.

More specifically, the purpose of the invention is to provide a package provided with easy-to-use holding means and allowing the transport of an object in complete safety.

An object of the invention is furthermore to provide such a package which, when not in use, has a reduced space requirement so as to limit the storage space for several packages.

Furthermore, the object of the invention is to provide such a package suitable for both transporting large objects and very small objects, in complete safety.

These purposes, as well as others which will appear later, are achieved thanks to the invention which relates to a package comprising a case having a bottom and a peripheral rim, the package also comprising a cover rotatably mounted on a side carrying the peripheral rim around a first axis of rotation, and which can adopt:

an open position in which the cover is spaced from the peripheral rim;

a closed position in which the cover is folded over the case and closes the latter, the package further comprising holding means for maintaining an object to be transported in the case, characterized in that the holding means comprise a frame rotatably mounted on the side carrying the peripheral rim in the vicinity of the bottom of the case, about a second axis of rotation directly below the first axis of rotation of the cover on the case, the frame being able to adopt:

a holding position in which the frame extends substantially parallel to the bottom of the case and surrounds the object to be transported;

a handling position in which the frame is spaced from the bottom of the case, the holding means also comprising elastically deformable means extending inside the frame, and a connecting rod for connection between the frame and the cover, the connecting rod being rotatably mounted on the cover and on the frame, the connecting rod, the cover, the side carrying the peripheral rim and the frame together forming a deformable parallelogram.

Such a package allows objects of different sizes to be transported safely while limiting its size when not in use.

Indeed, the deformation of the elastically deformable means allows both to obtain a large enveloping surface of the object but also a small thickness when the package is not in use. The elastically deformable means can thus be kept in the case without occupying a large place therein.

In addition, the use of a deformable parallelogram allows to make the holding means automatic in that, when the cover is brought to its closed position, the frame and the connecting rod force the elastically deformable means to deform in order to cover the transported object and press it against the bottom of the case.

According to a preferred embodiment, the frame comprises two side members parallel to each other and a cross member joining the two side members opposite the side carrying the peripheral rim.

Such a frame is simple in design and manufacture. Furthermore, by the use of hollow profiles, this frame offers good resistance to deformation, to the benefit of maintaining the object against the bottom of the case.

Advantageously, the cross member and the connecting rod form a single-piece assembly.

The main advantage of this single-piece assembly is to increase the rigidity of the frame, and therefore the holding of an object in the case.

Preferably, the connecting rod is in the shape of a flat panel.

A flat panel allows a homogeneous distribution of the forces applied to the cover on the frame. Moreover, the elastically deformable means can adapt to all, or almost all the shapes of objects to be transported, since the panel forming the connecting rod prevents the frame from deforming according to the shape of the object contained in the package.

Advantageously, the peripheral edge comprises four panels butted together and opposite in pairs.

The peripheral edge can thus adopt a rectangular, square or trapezoidal shape to contain objects of different shapes. Moreover, the use of separate panels, one of which forms the side carrying the peripheral edge, allows that in the event of maintenance, only one of the panels is changed.

This offers a definite advantage in terms of costs and in terms of ecology since only defective elements are changed.

Preferably, each panel of the peripheral edge can adopt:

a stowing position, in which it extends substantially parallel to the bottom of the case;

a use position, in which it extends substantially perpendicular to the bottom of the case.

Being able to position the panels in their stowing position or in their use position allows to form the case only when the package is in use.

Thus, when the package is not intended for use, it can be folded to reduce its space requirement, and stored.

Preferably, the case comprises means for blocking the panels in their use position.

These blocking means allow the panels to remain in their use position when the case is formed, in particular to allow the insertion of the object to be transported into the case.

Preferably, the elastically deformable means are in the form of an elastic fabric.

The use of an elastic fabric allows good holding of the object to be transported and has a small space requirement when the package is not in use.

Indeed, when the cover is in its closed position, the fabric completely covers the object and exerts pressure on the object, against the bottom of the case.

On the other hand, when the package is not in use, the fabric is thin and allows the folded package to be particularly compact.

Advantageously, the package comprises means for maintaining the cover in the closed position.

These means for maintaining the cover in the closed position ensure that the object is maintained in the package. Indeed, if the cover is not properly closed, there is a significant risk that it will open and that the elastically deformable means tend to resume their initial shape, that is to say unstretched shape. The object is then no longer kept in the package.

Furthermore, the means for holding the cover in the closed position can also be used as elements for verifying the inviolability of the package during transport.

In this case, the means for maintaining the cover in the closed position comprise, for example:

an opening made in the cover;

an aperture made in the peripheral edge, distant from the first axis of rotation of the cover with respect to the case, and a collar crossing the opening and the aperture.

These means for holding the cover in the closed position are simple to manufacture and use.

Other characteristics and advantages of the invention will emerge more clearly upon reading the following description of a preferred embodiment of the invention, given by way of illustrative and non-limiting example, and the appended drawings, among which:

Figure 7:
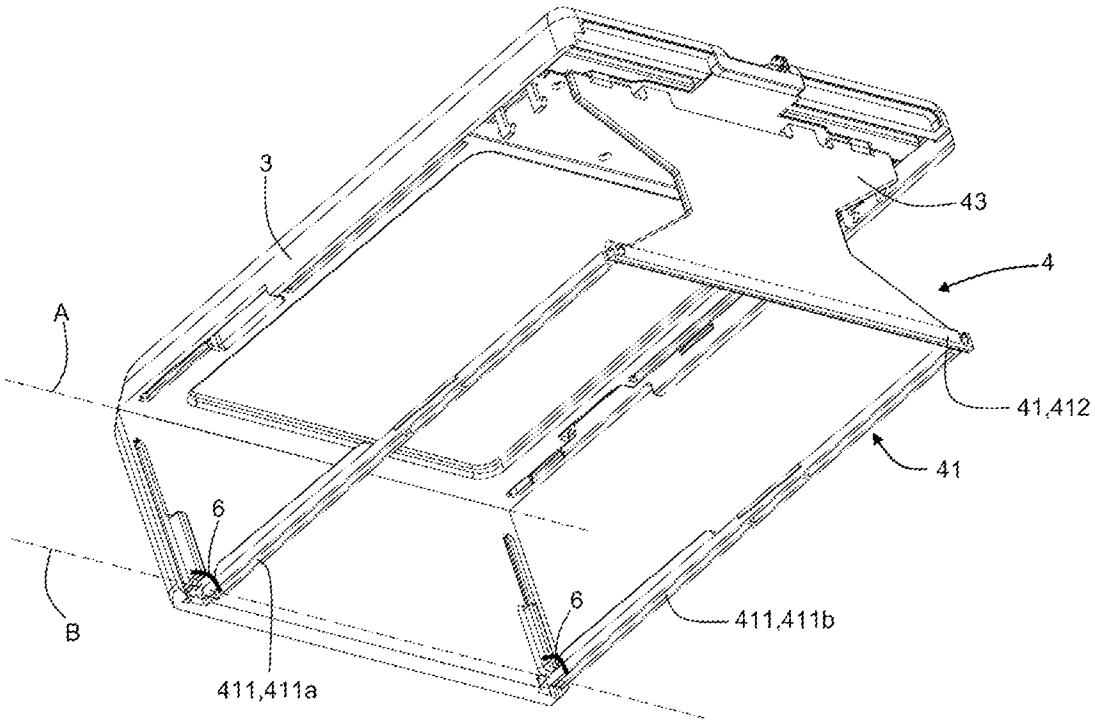
Figure 8:
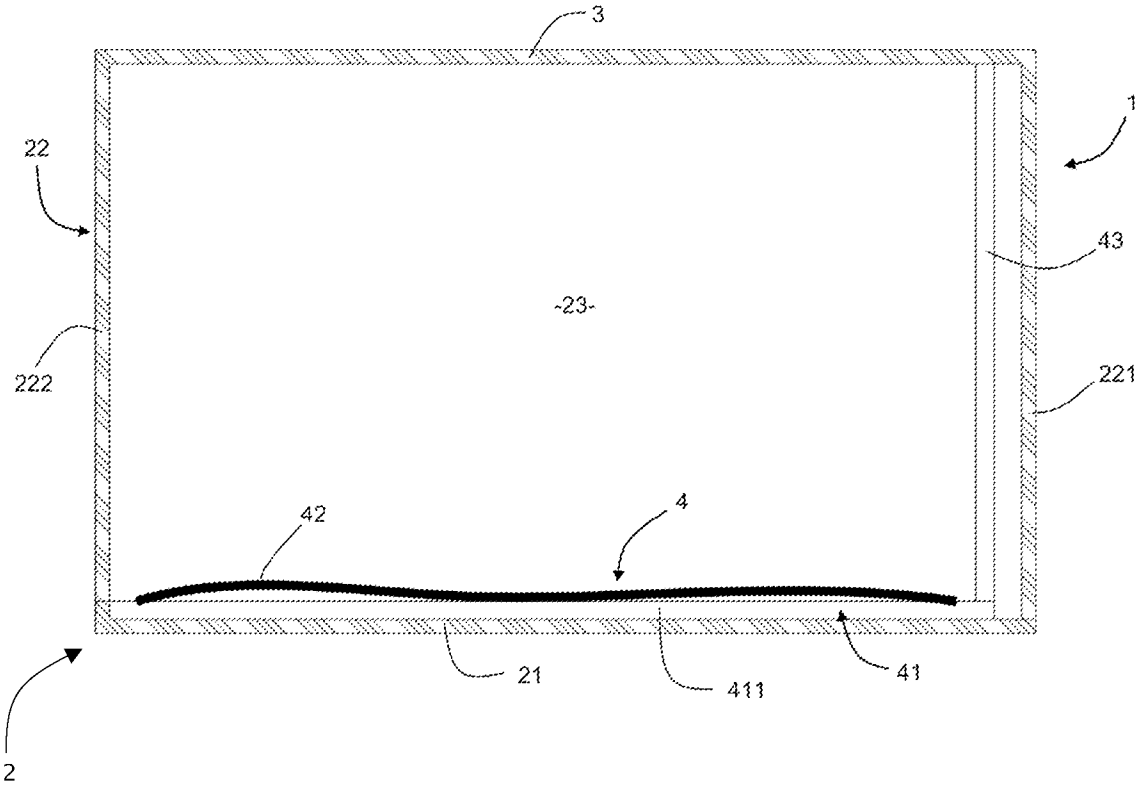
Figure 9:
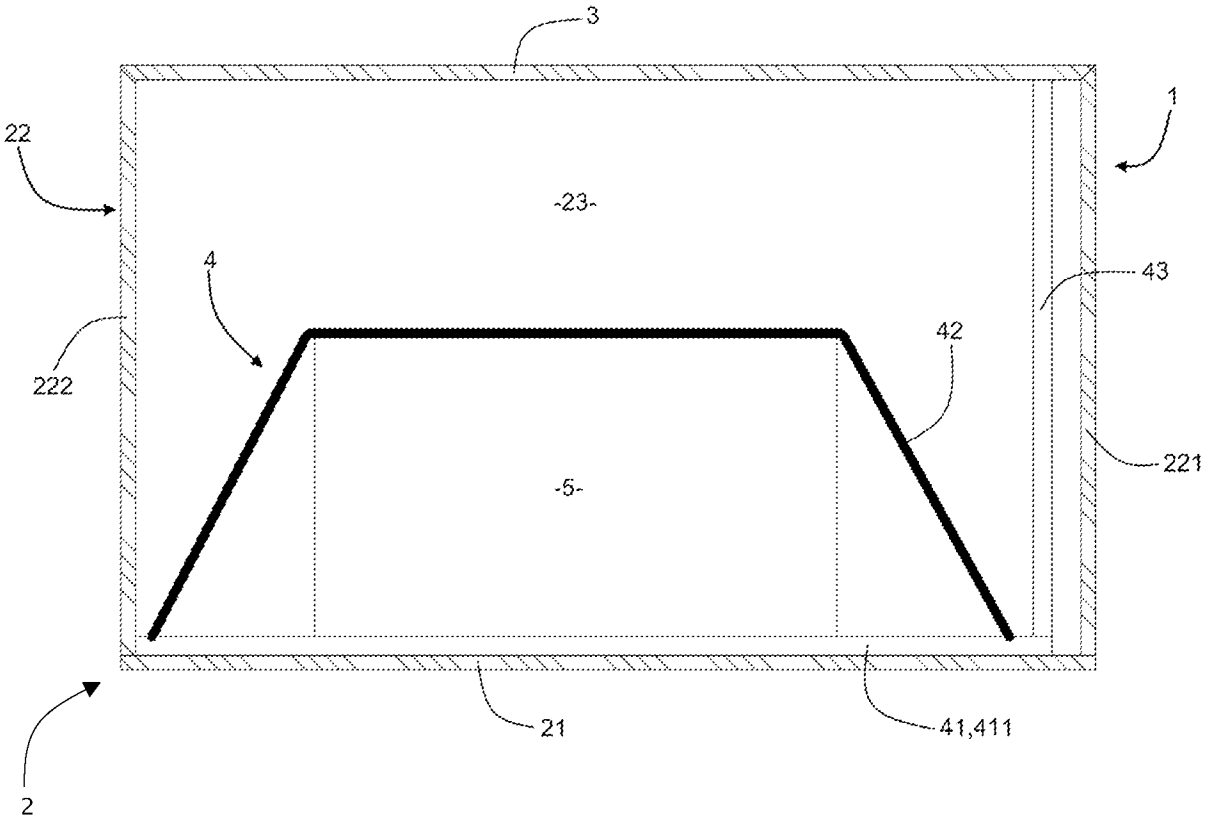

FIG. 7 a perspective bottom view of means for holding an object, for the package according to the invention;

FIG. 8 is a schematic longitudinal sectional representation of the package according to the invention, into which no object is inserted;

FIG. 9 is a longitudinal sectional representation of the package according to the invention, into which an object is inserted and held.

Figure 1:
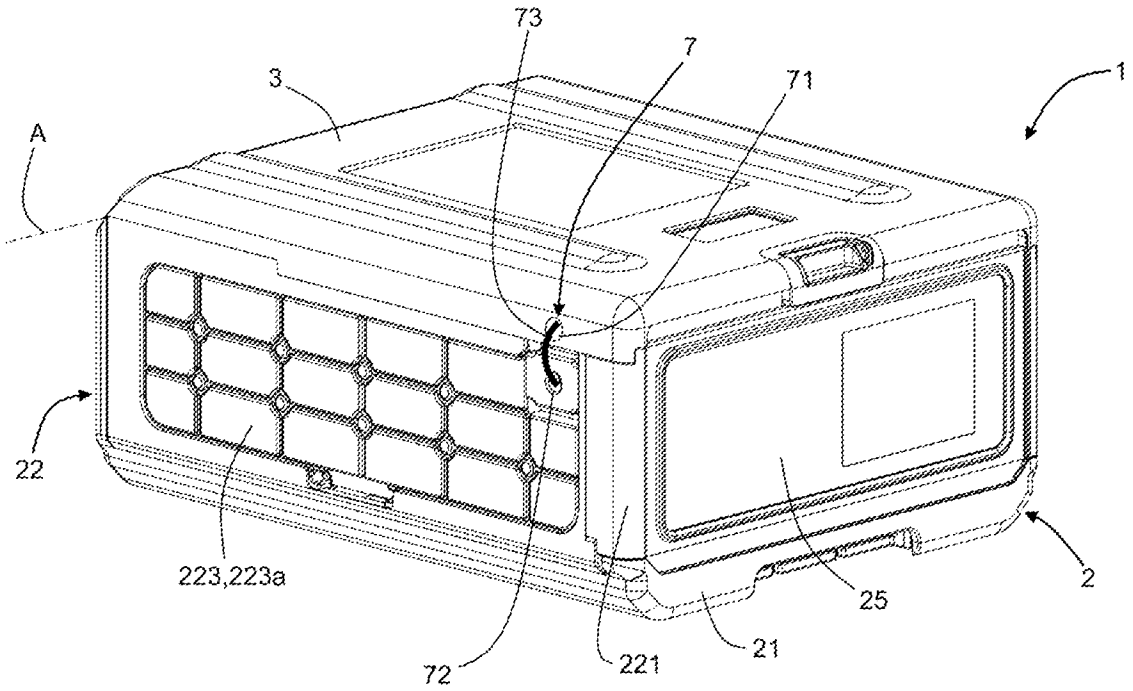
FIG. 1 is a perspective top view of a package according to the invention.

With reference to FIG. 1, a package 1 according to the invention is shown.

The package 1 comprises:

a case 2;

a cover 3;

holding means 4, for holding an object 5 (shown in FIG. 9) to be transported in the package 1.

As described below, the cover 3 is rotatably mounted on the case 2 around a first axis of rotation A. The cover 3 can then adopt:

an open position in which the cover 3 is spaced from the case 2;

a closed position in which the cover 3 is folded over the case 2 and closes the latter.

Preferably, the case 2 and the cover 3 are made of a robust material, in particular having characteristics of resistance to deformation and to shocks.

For this purpose, a light and resistant material such as expanded polypropylene can be used.

Other materials such as metal, plastic or a composite material (that is to say a material formed from several different materials) can also be used.

For example, a composite material being able to be used which comprises a woven reinforcement as well as a plastic resin.

The package 1 is thus reusable and resistant to the vagaries of use, in particular to shocks to which it is subjected. This limits its impact on the environment, particularly with regard to waste.

Indeed, once the object 5 is conveyed, the package 1 can be reused immediately for sending another object 5 or returned to a transporter who will reuse it.

Thus, the costs and pollution associated with recycling the package 1 are limited at its end of life, that is to say when the package 1 is too damaged to allow the transport of an object 5 in complete safety, or when a predetermined number of routing cycles is reached.

In other words, a conventional packaging made entirely, or almost entirely of cardboard, is generally destroyed and recycled as soon as it is finished. On the contrary, the package 1 according to the invention can be used several times before being recycled.

Moreover, the use of expanded polypropylene, plastic, composite material or metallic material allows the package 1 to withstand climatic conditions, in particular rain which significantly damages the cardboard of conventionally used packages.

The case 2 comprises:

a bottom 21 and a peripheral rim 22 extending from the bottom 21.

The case 2 is advantageously foldable.

"Foldable" means that the peripheral rim 22 is movable with respect to the bottom 21 and can adopt:—a stowing position (corresponding to the folded configuration of the package 1 illustrated in FIG. 2) in which the peripheral rim 22 is substantially parallel to the bottom 21; a use position in which the peripheral rim 22 extends substantially perpendicular to the bottom 21.

The bottom 21 and the peripheral rim 22 together define an internal volume 23 of the case 2. The peripheral rim 22 has a parallelepiped shape which defines an opening for access 24 to the internal volume 23 of the case 2.

Advantageously, the bottom 21 may have a cavity intended to receive an object 5, of small size. The cavity may further have a base having an adherent surface.

Figure 4:
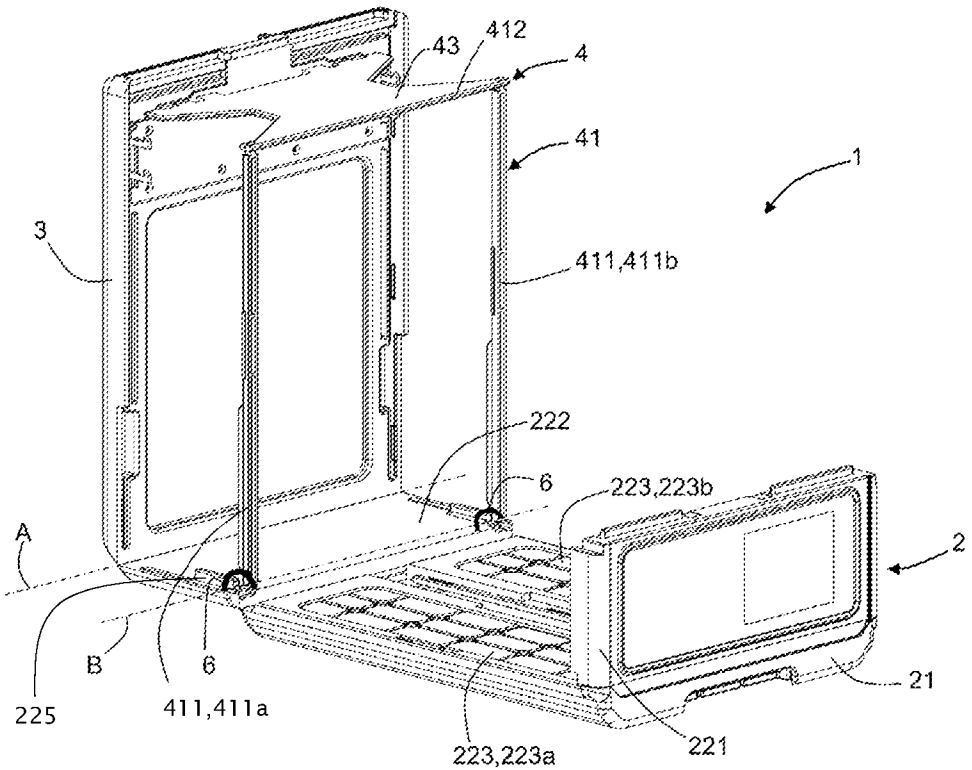
FIG. 4 is a perspective top view of the package according to the invention, according to a second shaping step.
Figure 5:
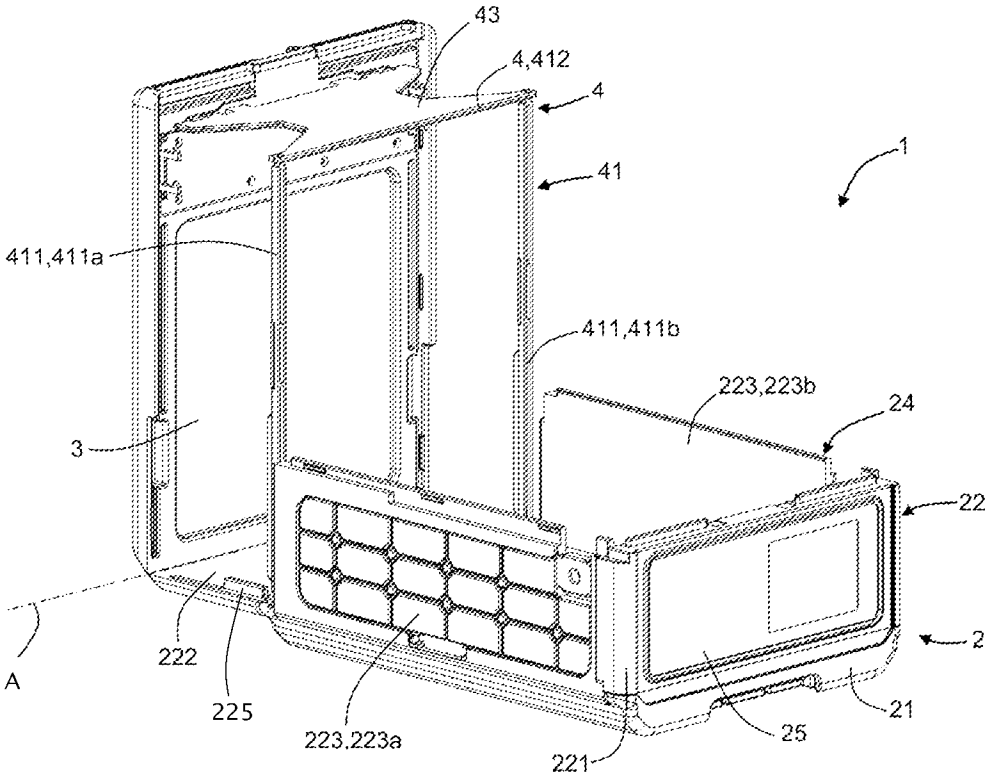
FIG. 5 is a perspective top view of the package according to the invention, according to a third shaping step.
Figure 6:
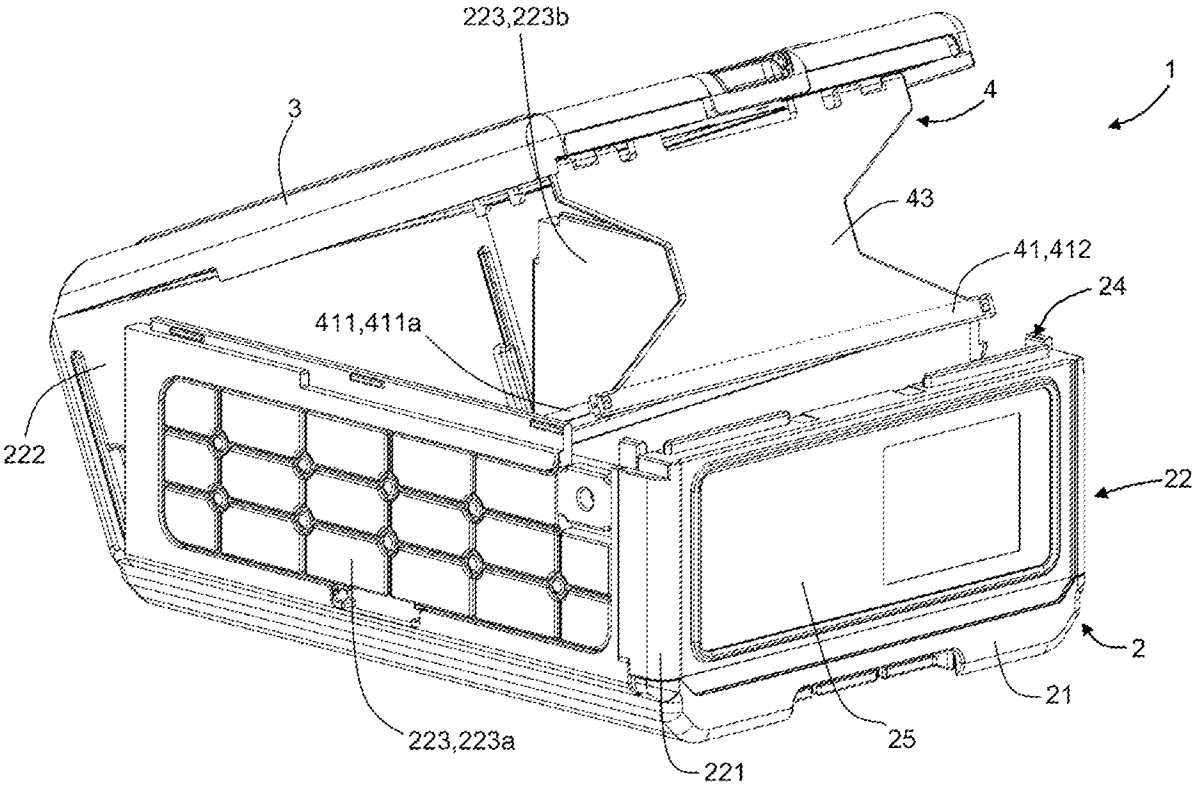
FIG. 6 is a perspective top view of the package according to the invention, according to a fourth shaping step.

As illustrated in FIGS. 4, 5 and 6, the peripheral rim 22 comprises four panels butted together and opposite in pairs, comprising:

a front panel 221, a rear panel 222;

two side panels 223.

More specifically, the peripheral rim 22 comprises a first side panel 223*a*, and a second side panel 223*b*.

The rear panel 222 and the front panel 221 are opposite to each other with respect to the bottom 21.

Likewise, the first side panel 223*a* and the second side panel 223*b* are also opposite to each other with respect to the bottom 21 and each connect the front panel 221 to the rear panel 223.

As explained below, one of the front panel 221, the rear panel 222 and the side panels 223 forms a side carrying the peripheral rim 22. Advantageously, the carrying side is formed by the rear panel 222.

Each of the front panel 221, the rear panel 222 and the side panels 223 is articulated to the bottom 21 of the case 2.

In other words, the front panel 221, the rear panel 222 and the side panels 223 can pivot with respect to the bottom 21 to allow the peripheral rim 22 to adopt its use position or its stowing position.

Thus, each of the front panel 221, the rear panel 222 and the side panels 223 can adopt: a stowing position (corresponding to the folded configuration of the package 1 illustrated in FIG. 2) in which it extends substantially parallel to the bottom 21, in the extension of or overlapping the latter;

a use position in which it extends substantially perpendicular to the bottom 21.

Each of the front panel 221, the rear panel 222 and the side panels 223 is independent of the others, and can therefore adopt its stowing position or its use position independently of the others.

According to an advantageous embodiment, the peripheral rim 22, the bottom 21 and the cover 3 are formed integrally, for example from expanded polypropylene. Thus, the pivots between the different elements of the package 1 are made by a thin thickness of material which acts as a hinge.

In a variant, each of the elements of the package 1 can be manufactured independently, and assembled to another element by a conventionally known hinge.

To secure the use of the package 1, particularly during the shaping of the case 2 or during the insertion of an object 5, the case 2 also comprises means for blocking the panels of the peripheral rim 22 in their use position. The blocking means advantageously belong to the following group:

by magnetism;

by insert:

by deformation;

by bracing, or interference.

For blocking means by bracing or interference, each side panel 223 comprises a hook projecting from the side panel 223, The hook thus leaves a space with a rim of the side panel 223, this space being intended to receive the front panel 221 or the rear panel 222.

Each hook is elastically deformable so that, when the front panel 221 and the rear panel 222 are shaped, they elastically deform each hook to contact a rim of a side panel 223. Each hook then recovers its initial shape to maintain the front panel 221 and the rear panel 222 against the rim of a side panel 223.

In a variant, the blocking means 225 may take the shape of tabs secured to the front panel 221 and the rear panel 222. These tabs are intended to be housed in slots made in the side panels 223. The cooperation between the tabs and the slots is advantageously tight so that, when the tabs are inserted into the slots, it is necessary to exert a significant pulling force on the front panel 221 and the rear panel 222 to release the tabs from the slots.

For blocking means 225 by insert, an insert, such as a pin or a stud, is inserted into openings made on the side panel 223, the front panel 221 and the rear panel 222, In this case, the front panel 221 and the rear panel 222, or the side panels 223 have returns intended to overlap the side panels 223, or the front panel 221 and the rear panel 222 respectively. The returns then have the opening intended to receive the insert.

The insert may comprise a central portion intended to pass through the panel openings, and two foldable stops, each located on either side of the central portion. The shape blocking of the peripheral rim 22 is then done by inserting the central part of the inserts into the openings of the panels, then folding the foldable stops so that the panels of the peripheral rim are sandwiched between the two foldable stops of the insert.

In the case of the blocking means 225 by magnetism, each panel of the peripheral rim 22 is provided with a magnet.

The front panel 221 and the rear panel 222, or the side panels 223 advantageously have returns intended to overlap the side panels 223, or the front panel 221 and the rear panel 222 respectively.

The returns then each carry a magnet intended to cooperate with another magnet facing each other. To enable their cooperation, the magnets are mated in pairs with reversed polarity. In other words, the magnets of the side panel 223, for example, have negative polarity, and the magnets of the front panel 221 and the rear panel 222 then have positive polarity, or vice versa.

For blocking means 225 by deformation, the side panels 223 have a lug projecting from each rim oriented towards the front panel 221 and the rear panel 222.

The front panel 221 and the rear panel 222 then have recesses each intended to cooperate with a lug.

The insertion of a lug into a corresponding recess then causes elastic deformation of the lug which, by seeking to recover its undeformed state, exerts a force on the recess. This then causes the panels to be held in position with respect to each other, and therefore the peripheral rim 22 to be maintained in the use position.

As illustrated in FIGS. 1, 3, 4, 5 and 6, the case 2 further comprises an electronic dialogue interface 25 allowing a user to interact with the package 1.

According to an advantageous aspect, the electronic dialogue interface 25 is connected on the one hand to the means for controlling the closed position of the cover 3, and on the other hand to a communication network to communicate with the latter.

For this purpose, the electronic dialogue interface 25 comprises communication means (not shown) for communicating with the communication network and more precisely with servers, as well as a communication device allowing the user to interact with the package 1.

Preferably, the electronic dialogue interface 25 comprises a smart panel (not illustrated) intended to allow communication between the various elements, that is to say the electronic dialogue interface 25, the means for controlling the closed position of the cover 3 and the remote server.

The communication between the electronic dialogue interface 25 and the means for controlling the closed position of the cover 3 allows in particular to guarantee the safety of the object 5 inside the package 1.

The holding means 4, illustrated in FIG. 7, comprise:

a frame 41 rotatably mounted on the peripheral rim 22;

elastically deformable means 42 extending inside the frame 41;

a connecting rod 43 for connection between the frame 41 and the cover 3.

More specifically, the frame 41 is rotatably mounted, around a second axis of rotation B, on the side carrying the peripheral rim 22, that is to say on the rear panel 222, in the vicinity of the bottom 21 of the case 2.

The second axis of rotation B is located directly below the first axis of rotation A.

The frame can thus adopt;

a holding position in which the frame extends substantially parallel to the bottom of the case and surrounds the object to be transported;

a handling position in which the frame is spaced from the bottom of the case.

The rotation of the frame 41 with respect to the rear panel 222 is in particular carried out by ad hoc means 6 such as for example a ring, a hook, a pin or else an elastic.

As illustrated in FIG. 7, the frame 41 comprises two side members 411 parallel to each other, including a first side member 411*a* and a second side member 411*b*, as well as a cross member 412 disposed between the side members 411.

The cross member 412 is mounted articulated with respect to the side members 411 opposite the side carrying the peripheral rim 22 on which the frame 41 is rotatably mounted.

Still referring to FIG. 7, the connecting rod 43 is rotatably mounted on both the frame 41 and the cover 3.

Advantageously, the connecting rod 43 is made integrally with the cross member 412.

In other words, the connecting rod 43 and the cross member 412 form a single piece.

This allows, as explained below, to guarantee good retention of the object 5 in the package 1 during its transport.

The connecting rod 43 is in the shape of a flat panel, a first end of which is rotatably mounted on the cover 3, and a second end, forming the cross member 412, is rotatably mounted on the frame 41, and more particularly on each of the side members 411.

The cover 3, the rear panel 222 (that is to say the side carrying the peripheral rim 22), the frame 41 and the connecting rod 43 thus form a deformable parallelogram.

This deformable parallelogram is particularly advantageous when using the package 1, as explained below.

The elastically deformable means 42 are advantageously in the form of an elastic fabric.

The main advantage of this elastic fabric is that it covers the entire object 5 when the frame 41 is in its holding position.

By completely covering the object 5, the elastic fabric applies a force to the entire object, this force tending to press the object against the bottom 21 of the case 2 and therefore to immobilize it.

Finally, the package also comprises means 7 for maintaining the cover 3 in the closed position (visible in FIG. 1).

These means 7 for maintaining the cover 3 in the closed position comprise:

an opening 71 made in the cover 3;

an aperture 72 made in the peripheral edge 22, distant from the first axis of rotation of the cover 3 with respect to the case 2, and a collar 73 passing through the opening 71 and the aperture 72.

The collar 73 can thus form visual means for verifying the integrity of the package 1 and in particular that the latter has not been opened during transport.

To use package 1, a user forms the shape of the package 1 from its storage configuration, as illustrated in FIGS. 2 to 6.

Figure 2:
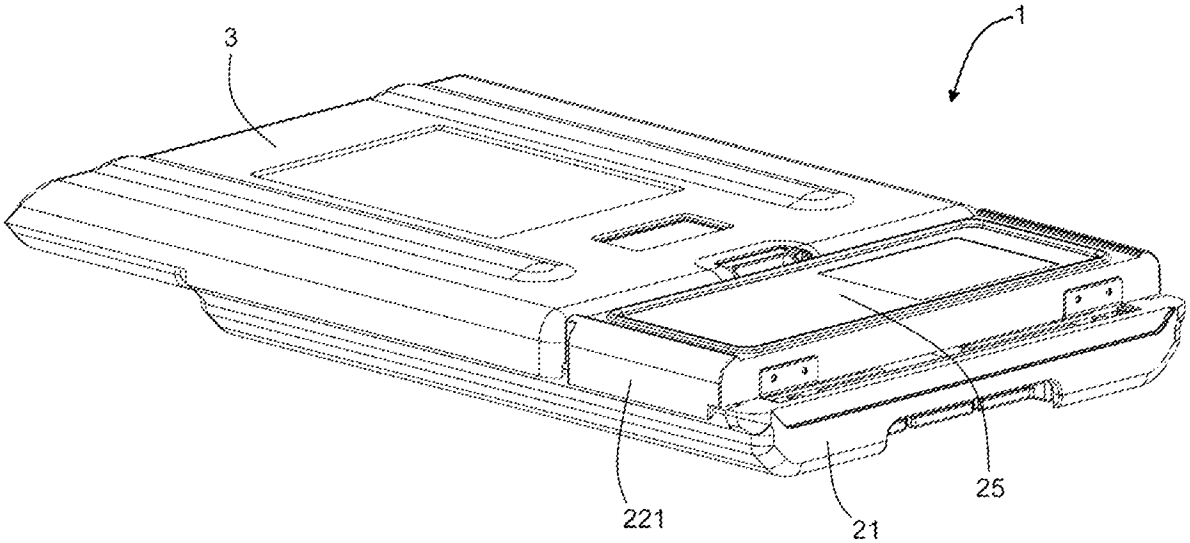
FIG. 2 is a perspective top view of the package according to the invention, in a folded configuration.

In its storage configuration, illustrated in FIG. 2, the panels of the peripheral edge 22 are in their stowing position and the package 1 is as follows:

the side panels 223 are folded over the bottom 21 of the case 2;

the front panel 221 is folded over the side panels 223;

the rear panel 222 extends substantially in the extension of the bottom 21 of the case;

the cover 3 is folded over the rear panel 222 and the side panels 223, and the frame 41 and the connecting rod 43 are substantially coplanar and located above the side panels 223 and below the front panel 221 and the cover 3.

The shaping of the package 1 is done according to the steps described below.

Figure 3:
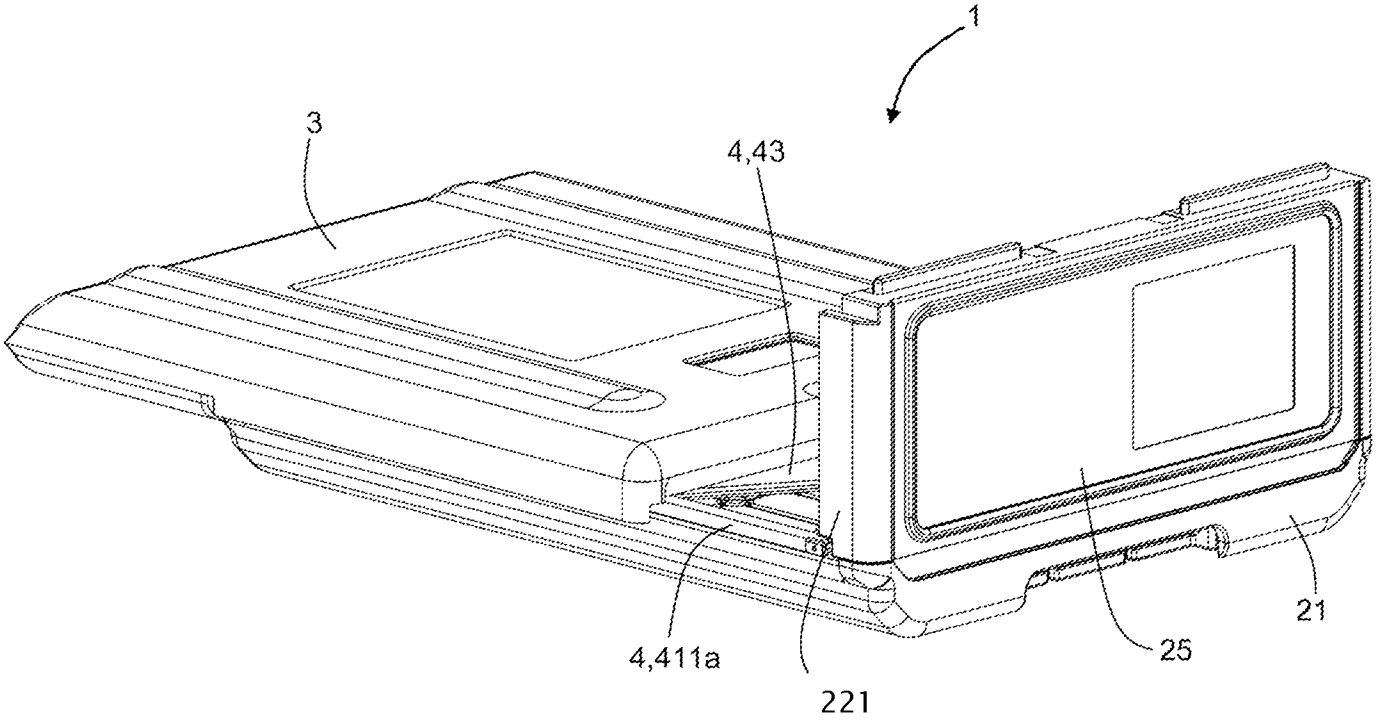
FIG. 3 is a perspective top view of the package according to the invention, according to a first shaping step.

In a first step, illustrated in FIG. 3, the user places the front panel 223 in its use position.

In a second step, illustrated in FIG. 4, the user places the cover 3 substantially perpendicular to the rear panel 222.

This handling has the effect of deforming the deformable parallelogram so that the frame 41 is substantially parallel to the cover 3, and the connecting rod 43 substantially parallel to the rear panel 222. More specifically, the frame 41 is then pressed, or almost pressed, against the rear panel 222 and the cover 3.

In a third step, illustrated in FIG. 5, the user places the side panels 223 in their use position.

In a fourth step, illustrated in FIG. 6, the user places the rear panel 222 in its use position and places the cover 3 in its closed position.

When no object 5 is placed in the case 2, the elastically deformable means 42 are not deformed as illustrated in FIG. 7.

On the other hand, when an object 5 is inserted into the case 2, as illustrated in FIG. 8, the elastically deformable means 42 deform to conform to the contours of the object 5.

More specifically, the elastic fabric deforms upon contact with the object 5 and exerts a force on the latter to press it against the bottom 21 of the case 2.

Thus, the object 5 is maintained during its transport and does not risk degrading.

The only handling of the cover 3 allows to hold or, on the contrary, to release the object 5 in the case 2.

Indeed, the handling of the cover 3 causes the deformation of the deformable parallelogram.

When the cover 3 is in its closed position, its handling to place it in its open position causes switching the frame 41 from its holding position to its handling position by the connecting rod 43.

If the elastically deformable means 42 are deformed by an object 5, and more specifically stretched over the object 5, then switching the frame 41 from its holding position to its handling position causes the relaxation of the elastically deformable means 42 and therefore the release of the object 5.

On the other hand, the reverse handling causes the holding of an object 5.

Handling the cover 3, in order to place it in its closed position, then causes switching the frame 41 from its handling position to its holding position by the connecting rod 43.

The elastically deformable means 42 are then deformed by the object 5, and more specifically stretched over the object 5, to press it against the bottom 21 of the case 2 and hold it during its transport.

According to an advantageous embodiment, the bottom 21 of the case may have an adherent coating allowing to increase the capacity for holding the object in position in the case 2.

The package 1 according to the invention therefore provides retention for the object 5 to be transported in a safe and automatic manner.

Indeed, holding the object in the case 2 is achieved by the simple handling of the cover 3. The user does not then have to worry about the integrity of the object 5 during its transport and only needs to position it on the bottom of the case 2.

Moreover, the user can extract the object 5 from the package just as easily, that is to say is simply by placing the cover 3 in its open position. In this position of the cover 3, the holding means 4 no longer act on the object 5.

The invention claimed is:

1. A package for conveying an object between two destinations comprising a case having a bottom and a peripheral rim comprising four panels butted together and opposite in pairs, wherein one of the panels forms a side carrying the peripheral rim, the package also comprising a cover rotatably mounted on the side carrying the peripheral rim, wherein the cover is rotatable with respect to the side carrying the peripheral rim about a first axis of rotation through an edge of the cover and an edge of the side carrying the peripheral rim, and holding means for maintaining the object to be transported in the case, wherein the holding means comprise a frame rotatably mounted on the side carrying the peripheral rim in the vicinity of the bottom of the case, wherein the frame is rotatable with respect to the side carrying the peripheral rim about a second axis of rotation below the first axis of rotation of the cover on the case while the case is in the closed position, wherein the cover can adopt:

an open position in which the cover is spaced from the peripheral rim at three sides other than the side carrying the peripheral rim;

a closed position in which the cover is folded over the case and closes the latter, the package further comprising holding means for maintaining the object to be transported in the case, the frame being able to adopt:

a holding position in which the frame extends substantially parallel to the bottom of the case and surrounds the object to be transported;

a handling position in which the frame is spaced from the bottom of the case at three sides other than the side carrying the peripheral rim, the holding means also comprising elastically deformable means extending inside the frame, and a connecting element for connection between the frame and the cover, the connecting element being rotatably mounted on the cover and on the frame, the connecting element, the cover, the side carrying the peripheral rim and the frame together forming a deformable parallelogram.

2. The package according to claim 1, wherein the frame comprises two side members parallel to each other and a cross member joining the two side members opposite the side carrying the peripheral rim.

3. The package according to claim 2, wherein the cross member is formed as a portion of the connecting element.

4. The package according to claim 1, wherein the connecting element is in the shape of a flat panel.

5. The package according to claim 1, wherein each panel of the peripheral rim can adopt:

a stowing position, in which each panel extends substantially parallel to the bottom of the case;

a use position, in which each panel extends substantially perpendicular to the bottom of the case.

6. The package according to claim 5, wherein the case comprises means for blocking the panels in their use position.

7. The package according to claim 1, wherein the elastically deformable means are in the form of an elastic fabric.

8. The package according to claim 1, wherein the package comprises means for holding the cover in the closed position.

9. The package according to claim 8, wherein the means for holding the cover in the closed position comprise:

an opening made in the cover;

an aperture made in the peripheral rim, distant from the first axis of rotation of the cover with respect to the case, and a collar passing through the opening and the aperture.

10. A package for conveying an object between two destinations comprising a case having a bottom and a peripheral rim, the package also comprising a cover rotatably mounted on a side carrying the peripheral rim around a first axis of rotation, and which can adopt:

an open position in which the cover is spaced from the peripheral rim;

a closed position in which the cover is folded over the case and closes the latter, the package further comprising holding means for maintaining the object to be transported in the case, wherein the holding means comprise a frame rotatably mounted on the side carrying the peripheral rim in the vicinity of the bottom of the case, about a second axis of rotation below the first axis of rotation of the cover on the case while the case is in the closed position, the frame being able to adopt:

a holding position in which the frame extends substantially parallel to the bottom of the case and surrounds the object to be transported;

a handling position in which the frame is spaced from the bottom of the case, the holding means also comprising elastically deformable means extending inside the frame, and a connecting element for connection between the frame and the cover, the connecting element being rotatably mounted on the cover and on the frame, the connecting element, the cover, the side carrying the peripheral rim and the frame together forming a deformable parallelogram, wherein the peripheral rim comprises four panels butted together and opposite in pairs, wherein one of the panels forms the side carrying the peripheral rim, wherein each panel of the peripheral rim can adopt:

a stowing position, in which each panel extends substantially parallel to the bottom of the case;

a use position, in which each panel extends substantially perpendicular to the bottom of the case.

11. The package according to claim 10, wherein the case comprises means for blocking the panels in their use position.

* * * * *